US007153165B2

(12) United States Patent
Lai et al.

(10) Patent No.: US 7,153,165 B2
(45) Date of Patent: Dec. 26, 2006

(54) TERMINAL-PROTECTIVE CARD CONNECTOR

(75) Inventors: Yaw-Huey Lai, Taipei County (TW); Dong-Chu Feng, Huna Province (CN)

(73) Assignee: Tai-Sol Electronics Co., Ltd. (TW)

( * ) Notice: Subject to any disclaimer, the term of this patent is extended or adjusted under 35 U.S.C. 154(b) by 0 days.

(21) Appl. No.: 11/194,675

(22) Filed: Aug. 2, 2005

(65) Prior Publication Data

US 2006/0270278 A1 Nov. 30, 2006

(30) Foreign Application Priority Data

May 30, 2005 (TW) ..... 94208935 U

(51) Int. Cl.
*H01R 24/00* (2006.01)

(52) U.S. Cl. ..... 439/630

(58) Field of Classification Search ..... 439/630, 439/138, 137, 218; 361/737
See application file for complete search history.

(56) References Cited

U.S. PATENT DOCUMENTS 6,641,413 B1 11/2003 Kuroda
6,699,053 B1 * 3/2004 Kuroda ..... 439/218
6,796,842 B1 * 9/2004 Wang ..... 439/630
6,863,571 B1 * 3/2005 Sato et al. ..... 439/630
6,913,492 B1 * 7/2005 Kuroda et al. ..... 439/631
6,926,560 B1 * 8/2005 Chu ..... 439/630
6,932,654 B1 * 8/2005 Washino ..... 439/630

* cited by examiner

*Primary Examiner*—Gary F. Paumen
(74) *Attorney, Agent, or Firm*—Bacon & Thomas PLLC

(57) ABSTRACT

A terminal-protective card connector includes a shell and a pressing member. The shell includes at least two groups of terminals mounted to the shell. The second group of terminals each have a part elastically rising upward and backward. The pressing member includes a plurality for elongated slots formed therein and a plurality of pressing points each defined under a front end of each elongated slot. The pressing member is provided with two ends pivotally mounted in the shell for pivoting movement. One group of terminals extends through bottom sides and then top sides of the elongated slots respectively, having a part contacting against and supporting the pressing points to enable the pressing member to rise for a predetermined height. Thus, a specific group of terminals can be optionally pressed to avoid deformation or short circuit resulted from impact of or contact with uncorresponding cards to be protected.

7 Claims, 8 Drawing Sheets

TERMINAL-PROTECTIVE CARD CONNECTOR

BACKGROUND OF THE INVENTION

1. Field of the Invention

The present invention relates generally to electronic apparatuses, and more particularly, to a terminal-protective card connector.

2. Description of the Related Art

A conventional all-in-one card connector includes a large number of terminals extending into inside space of a shell thereof and corresponding in location to contact pins of various kinds of memory cards, for a variety of electronic cards.

However, because all of the terminals of the aforesaid card connector extend into the inside space of the shell, while an electronic card is inserted into the card connector, the card is subject to friction with or impact on the uncorresponding terminals of the card connector to deform the terminals to further affect the access to the card. In light of this, protecting the terminals becomes a significant issue for improvement of the all-in-one card connector.

As disclosed in the prior art, like U.S. Pat. No. 6,641,413, a slidable member is slidably moved inside a card connector for pressing terminals corresponding to an SD (Secure Digital) card or an MMC (Multi Media Card) card to prevent the terminals from impacting an MS (Memory Stick) card while the MS card is inserted therein.

The present applicant provides a solution of not only protecting the terminals mounted inside the card connector but also being different in technical feature and structure from the above-mentioned patent.

SUMMARY OF THE INVENTION

The primary objective of the present invention is to provide a terminal-protective card connector, which prevents terminals from deformation or damage incurred by impact of electronic cards not corresponding to the terminals.

The secondary objective of the present invention is to provide a terminal-protective card connector, which optionally presses a specific group of terminals therein.

The foregoing objectives of the present invention are attained by the terminal-protective card connector, which is composed of a shell and a pressing member. The shell includes an opening formed at a front end thereof, and at least two (first and second) groups of terminals mounted to the shell and extending into inside space of the shell. The first group of terminals each have a part elastically rising upward and backward. The pressing member includes at least one bevel formed at a front end thereof, a plurality of elongated slots formed therein, and a plurality of pressing points each defined under a front end of each elongated slot. The pressing member is provided with two ends pivotally mounted in the shell for pivoting movement caused by a force. The second group of terminals run extends through bottom sides and then top sides of the elongated slots respectively, each having a part contacting against and supporting each pressing point to enable the pressing member to rise for a predetermined height.

The present invention employs the pressing member to press the second group of the terminals to optionally pressing a specific group of terminals and to prevent the terminals from deformation and short circuit incurred by impact and insertion of uncorresponding cards, further effecting the protection of the terminals.

DETAILED DESCRIPTION OF PREFERRED EMBODIMENTS

Figure 1:
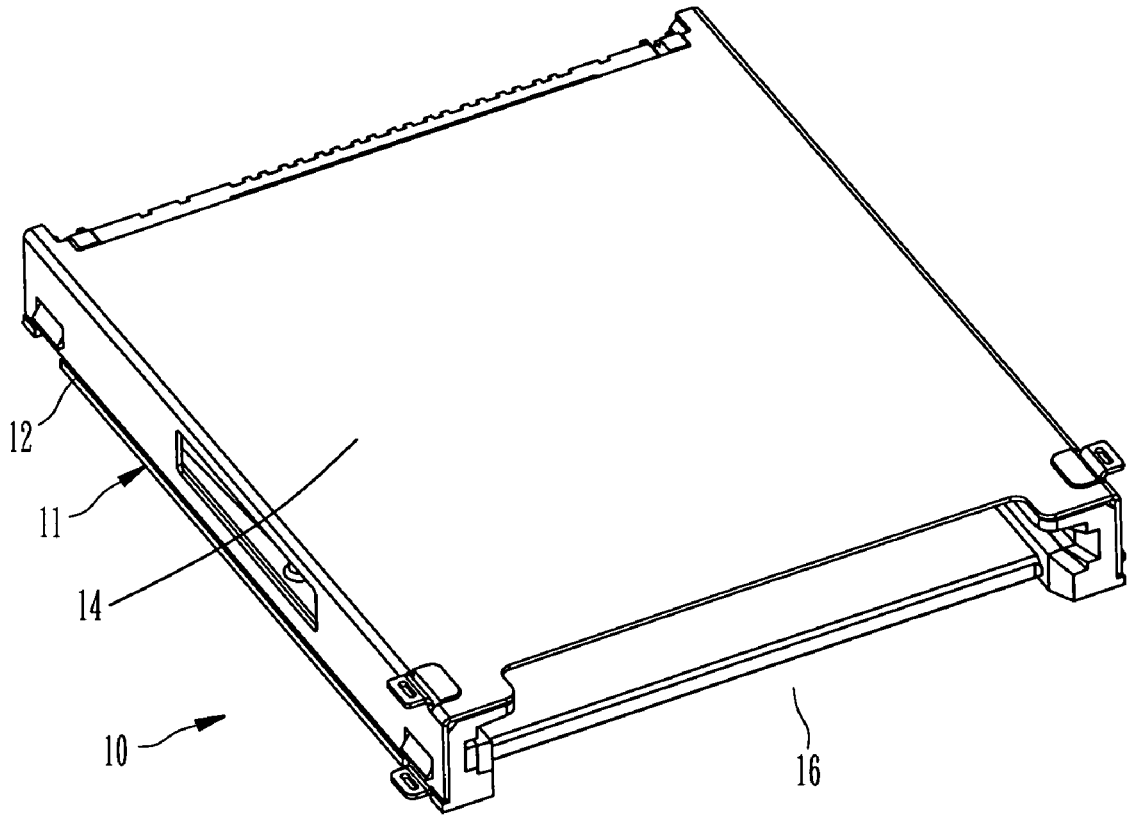
FIG. 1 is a perspective view of a preferred embodiment of the present invention.
Figure 2:
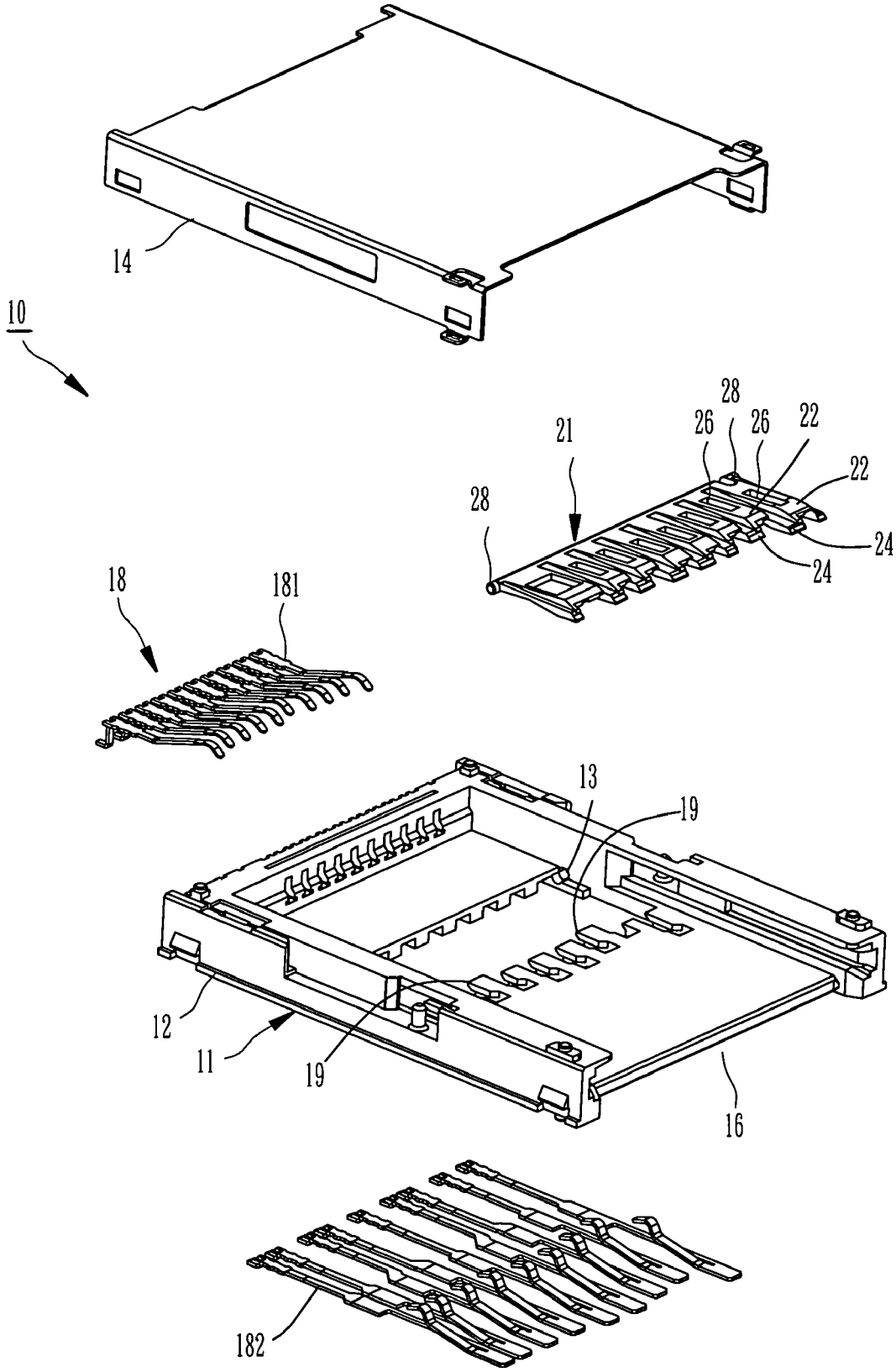
FIG. 2 is an exploded view of the preferred embodiment of the present invention.
Figure 3:
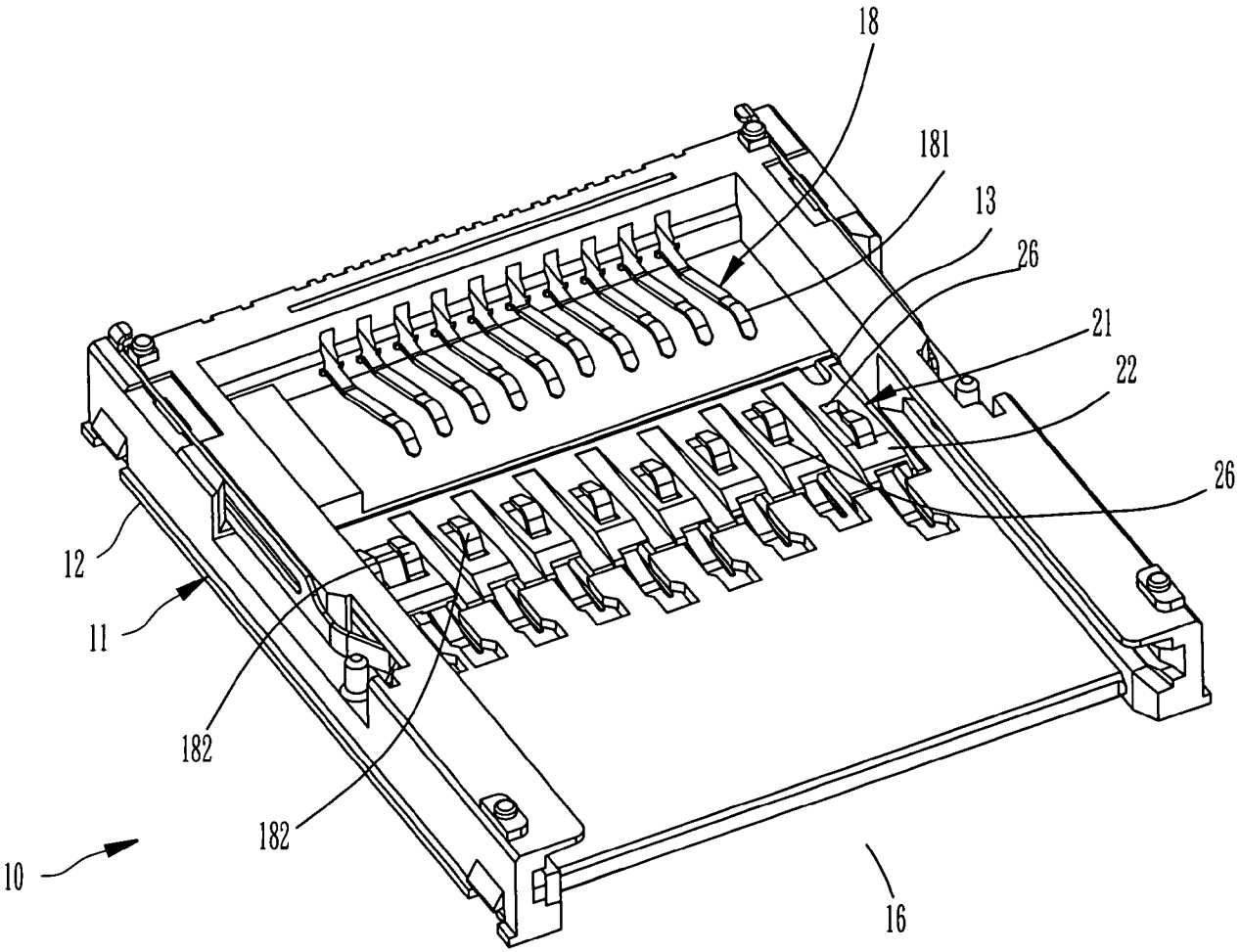
FIG. 3 is another perspective view of the preferred embodiment of the present invention, from which a cover plate is removed.

Referring to FIGS. 1–4, a terminal-protective card connector 10 constructed according to a preferred embodiment of the present invention is composed of a shell 11 and a pressing member 21.

The shell 11 includes a base frame 12, a cover plate 14 mounted on the base frame 12, an opening 16 formed at a front end thereof, and at least two groups of terminals 18 mounted to the base frame 12 and extending into an inside space defined between the base frame 12 and the cover plate 14. In this embodiment, there are two groups of the terminals 18, i.e. a first group of terminals 181 and a second group of terminals 182. The first group of terminals 181 are located at a rear end of the base frame 12 for corresponding to an MS card. The second group for terminals 182 are located at a top side of the base frame 12 for corresponding to an SD/MMC card, each having a part which elastically rises upward and backward and has a distal end bending slightly downward. The base frame 12 has a stopping portion 19 facing downward and backward.

The pressing member 21 includes at least one bevel 22 formed at a front end thereof and extending forward and downward from the front end thereof, a retaining portion 24 further extending forward and downward from the front end thereof under the bevel 22, a plurality of elongated slots 26, a plurality of pressing points 27 defined respectively under front ends of the elongated slots 26, and two lugs 28 extending outward from two sides of a rear end thereof respectively. The base frame 12 has two cavities 13 formed internally at two sides thereof for receiving the two lugs 28. The pressing member 21 is pivotable under a force on the two lugs 28 received in the two cavities 13 with respect to the base frame 12. The second group of terminals 182 extends through bottom sides and then top sides of the elongated slots 26 and each has a part contacting against and supporting the pressing point 27 to enable the pressing member 21 to rise for a predetermined height and to enable the retaining portion 24 to contact against the stopping portion 19.

An MS card 91 and an SD/MMC card 92 are taken for examples to illustrate the operation of the present invention.

Figure 4:
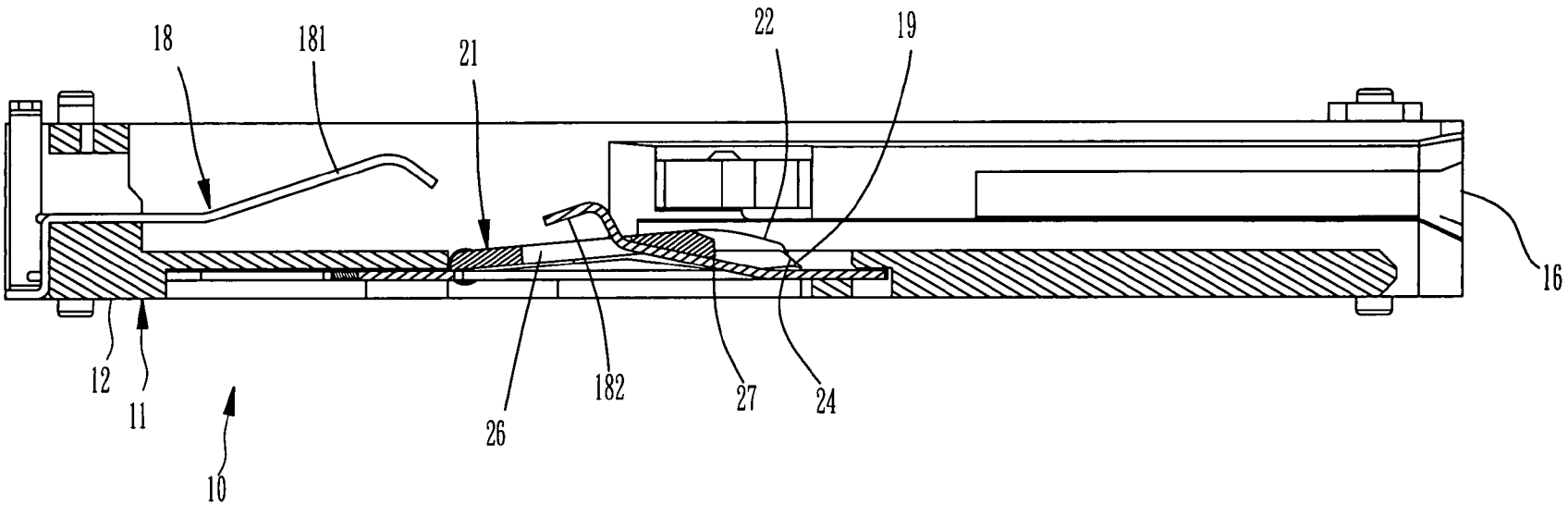
FIG. 4 is a sectional view of FIG. 3.

Referring to FIG. 4, before any card is inserted into the card connector 10, the pressing member 21 is supported to rise by the upward resilience generated from the raised second group of terminals 182. A stop point of uprising is defined where the retaining portion 24 contacts against the stopping portion 19.

Figure 5:
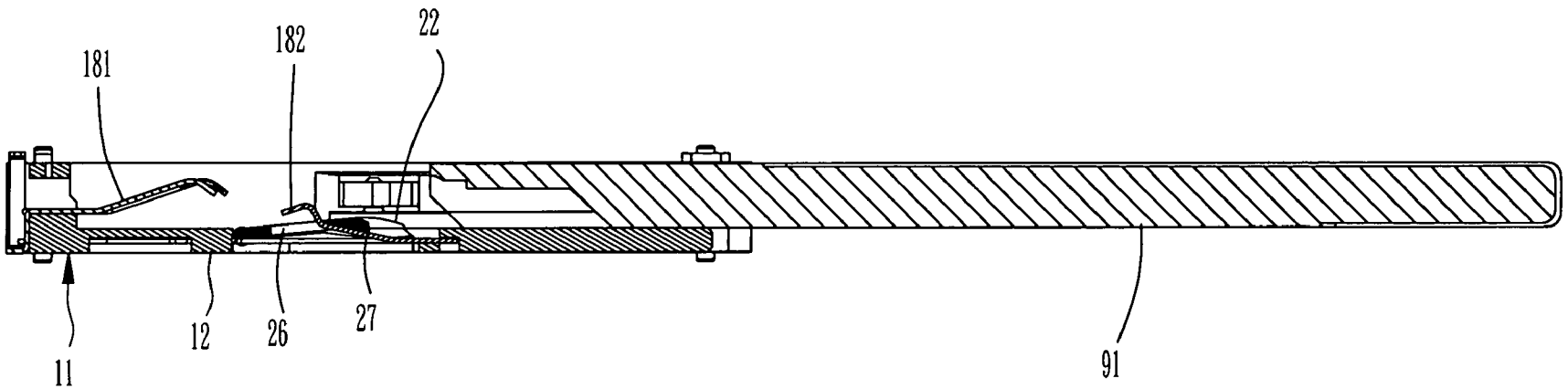
FIG. 5 is another sectional view of FIG. 3, showing that an MS card contacts against a bevel of a pressing member while the MS card is inserted.

Referring to FIG. 5, while inserted into the card connector 10, the MS card 91 has its front end contacting against the bevel 22. Next, referring to FIG. 6, while moved further into the card connector 10, the MS card 91 presses the bevel 22 to enable the pressing member 21 to pivot downward to enable the pressing points 27 to press the second group of terminals 182; meanwhile, the second group of terminals 182 have distal ends located in the elongated slots 26. Finally, referring to FIG. 7, the MS card 91 continues to move forward to an internal rear end of the shell 11 to contact the first group of terminals 181, thus completing the insertion of the MS card 91 into the card connector 10. As indicated above, during the insertion of the MS card 91, the MS card 91 does not touch the second group of terminals 182, thereby avoiding problems of impacting or damaging the terminals 18.

Figure 6:
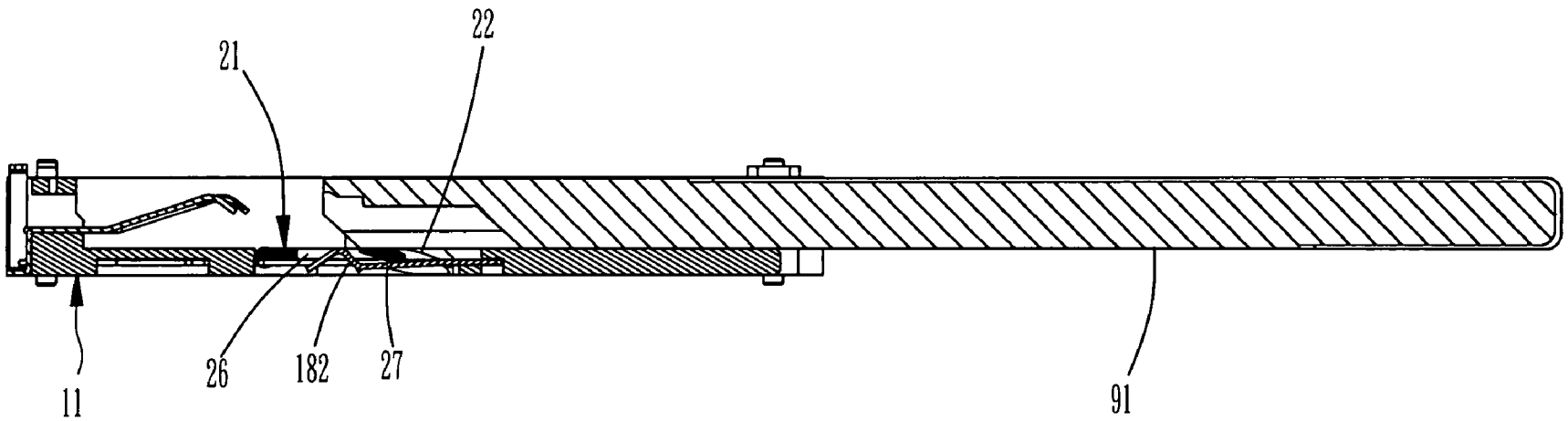
FIG. 6 is similar to FIG. 5, showing that the MS card is moved further to press the pressing member.
Figure 7:
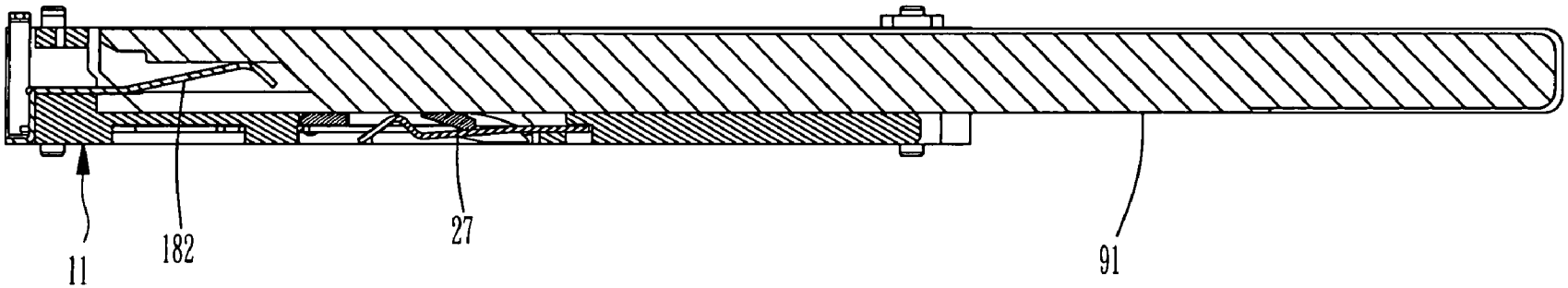
FIG. 7 is similar to FIG. 5, showing that the MS card is fully inserted into the card connector.

While the MS card 91 is being pulled out of the card connector 10, the pulling operation is converse to the insertion operation indicated above. As shown in FIG. 6, the second group of terminals 182 remains pressed. As the MS card 91 is moved to a position as shown in FIG. 5, the pressing member 21 gets rid of the pressing and is forced to rise by the upward resilience of the second group of terminals 182. In the meantime, the MS card 91 has its bottom side fully disengaged from the second group of terminals 182 to impact the second group of terminals 182 no longer. Thus, while being pulled out of the card connector 10, the MS card 91 does not impact or touch the second group of terminals 182 such that the terminals 18 can be protected from deformation and damage.

Figure 8:
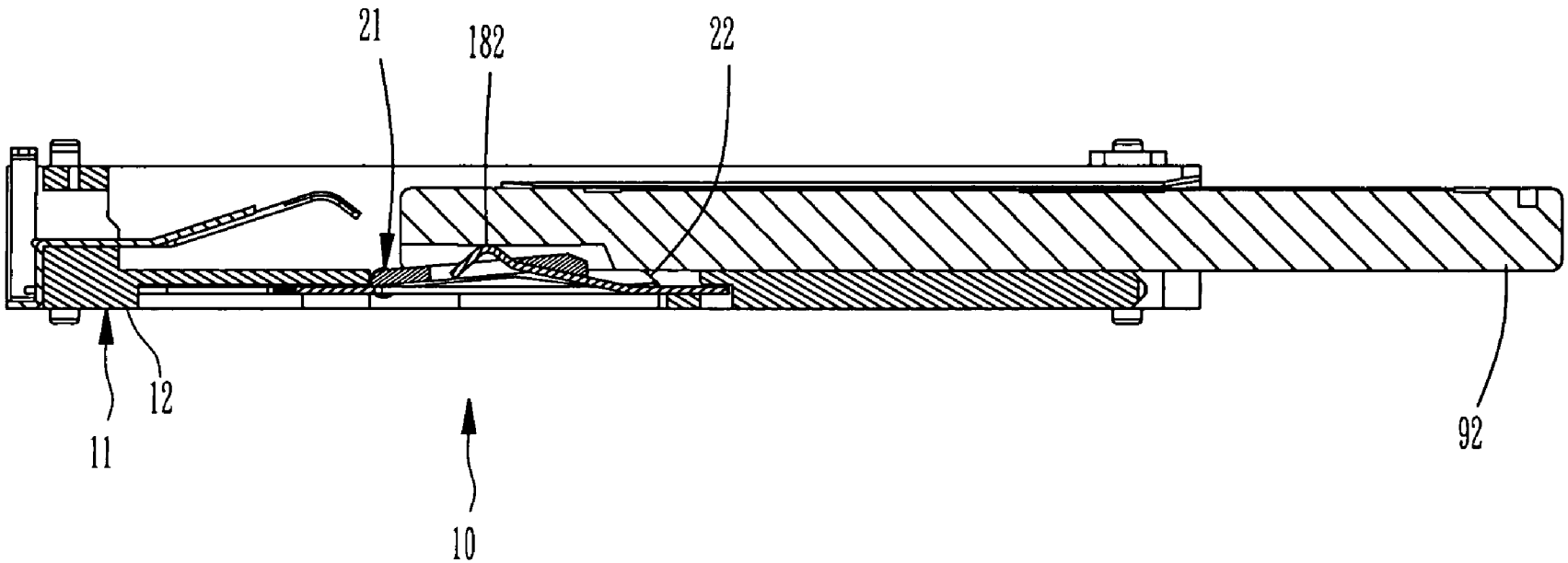
FIG. 8 is similar to FIG. 5, showing that an SD card is fully inserted into the card connector.

Referring to FIG. 8, while an SD/MMC card 92 having a recessed portion at its bottom front end is inserted into the card connector 10, the SD/MMC card 92 fails to work on the bevel 22 of the pressing member 21 such that the pressing member 21 does not press the second group of terminals 182 and thus the SD/MMC card 92 directly contacts the second group of terminals 182.

In conclusion, the present invention includes advantages recited below.

1. Protection of the terminals: The present invention allows the terminals (the second group of terminals 182) for the SD/MMC card to be pressed without impact while the MS card 91 is inserted therein, further protecting the second group of terminals 182 from deformation or damage incurred by the impact of the MS card 91 and securing the reliability of operating the card connector.
2. Optional pressing of the terminals: The present invention presses the second group of terminals 182 while the MS card 91 is inserted therein, and does not press the same while the SD/MMC card 92 is inserted therein, optionally pressing specific terminals and thus effecting the protection of the specific terminals. In addition, while the MS card 91 having a metallic housing is inserted, the present invention can prevent the terminals (the second group of terminals 182) from short circuit caused by contacting the metallic housing.
3. Short stroke: The aforementioned slidable member defined in the U.S. Pat. No. 6,641,413 has to be slidably moved for a predetermined distance to lift the terminals for the SD card. The present invention directly enables the pressing member 21 to optionally press the terminals, having shorter stroke than the port art. Thus, the present invention structurally facilitates the operation of lifting and pressing the terminals and facilitates control of precision.

It is to be noted that the present invention is not limited to the MS card 91 and SD/MMC card 92, which are for examples only, but including other electronic cards structurally similar thereto.

What is claimed is:

1. A terminal-protective card connector comprising:

a shell having an opening and at least two groups of terminals, said opening being formed at a front end of said shell, said at least two groups of terminals being defined as a first group of terminals and a second group of terminals mounted in said shell and extending into an inside space of said shell, said first group of terminals being located at an internal rear end of said shell, said second group of terminal being located at an internal bottom side of said shell and each having a part elastically rising upward and backward; and a pressing member having at least one bevel formed at a front end thereof, a plurality of elongated slots formed thereon, a plurality of pressing points defined under a front end of each of said elongated slots, said pressing member having two ends pivotally mounted in said shell for pivoting movement caused by a force, said second group of terminals extending through bottom sides and then top sides of said elongated slots and each having a part contacting and supporting each of said pressing points, whereby said pressing member is lifted by said second group of terminals for a predetermined height.

2. The card connector as defined in claim 1, wherein said bevel extends forward and downward from the front end of said pressing member.

3. The card connector as defined in claim 1, wherein said shell includes a base frame and a cover plate mounted on said base frame.

4. The card connector as defined in claim 1, wherein said second group of terminals are provided with distal ends bending slightly downward.

5. The card connector as defined in claim 1, wherein said pressing member includes two lugs extending outward respectively from two sides thereof; said shell including two cavities formed internally at two sides thereof, said two lugs being received respectively in said two cavities.

6. The card connector as defined in claim 1, wherein said pressing member further includes a retaining portion extending forward from the front end thereof under said bevel; said shell further includes a stopping portion formed internally at a bottom side thereof and facing downward and backward, said pressing member being supported by said second group of terminals to rise, said retaining portion contacting against said stopping portion.

7. The card connector as defined in claim 1, wherein said first group of terminals correspond to an MS card; said second group of terminals correspond to an SD/MMC card.

* * * * *